US005660017A

United States Patent [19]

Houghton

[11] Patent Number: 5,660,017

[45] Date of Patent: Aug. 26, 1997

[54] STEEL MOMENT RESISTING FRAME BEAM-TO-COLUMN CONNECTIONS

[76] Inventor: David L. Houghton, 15901 Hawthorne Blvd., #400, Lawndale, Calif. 90260

[21] Appl. No.: 354,954

[22] Filed: Dec. 13, 1994

[51] Int. Cl.[6] ..... E04B 1/19; E04B 1/38

[52] U.S. Cl. ..... 52/655.1; 52/167.3; 52/236.6; 52/283; 52/653.1

[58] Field of Search ..... 52/236.3, 236.6, 52/236.7, 236.8, 236.9, 167.3, 263, 280, 283, 289, 656.1, 653.1, 655.1; 403/270, 271, 272, 337, 341

[56] References Cited

U.S. PATENT DOCUMENTS

| | | | |
|---|---|---|---|
| 574,434 | 1/1897 | Keithley | 52/289 |
| 1,883,376 | 10/1932 | Hilpert et al. | 52/236.6 |
| 4,091,594 | 5/1978 | Yamashita | 52/283 |

FOREIGN PATENT DOCUMENTS

| | | | |
|---|---|---|---|
| 771849 | 11/1967 | Canada | 52/283 |
| 619608 | 8/1978 | U.S.S.R. | 52/167.3 |

*Primary Examiner*—Michael Safavi
*Attorney, Agent, or Firm*—Roger A. Marrs

[57] ABSTRACT

A steel moment resisting frame (SMRF) connection connects a vertical column to a horizontal beam. It is useful in both original and retrofit construction. A primary trunk assembly is comprised of two, vertical, parallel plates which are welded to the vertical column on opposing sides and which plates extend from the column along the sides of a horizontal beam. A secondary branch assembly is comprised of the horizontal beam and horizontal plates which are welded to the flanges of the horizontal beam. Such plates are welded also to the vertical parallel plates, thereby connecting the column to the beam. Additional plates may be welded between the web and flanges of the horizontal beam and the vertical, parallel plates and, also, between the web and flanges of the vertical column and the vertical, parallel plates.

18 Claims, 3 Drawing Sheets

FIG. 7
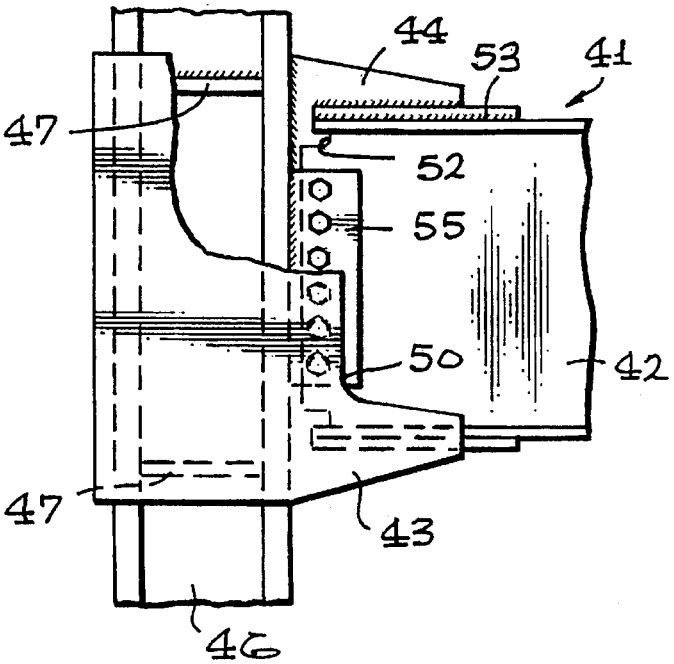
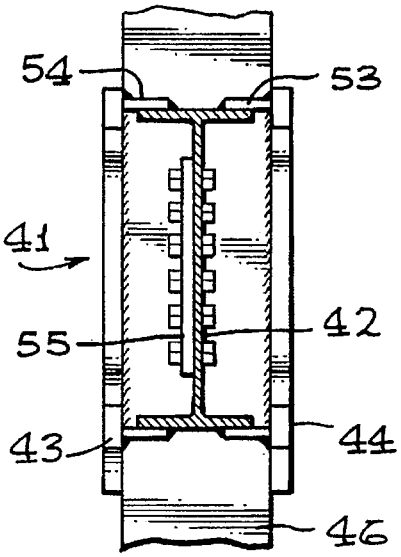
FIG. 8
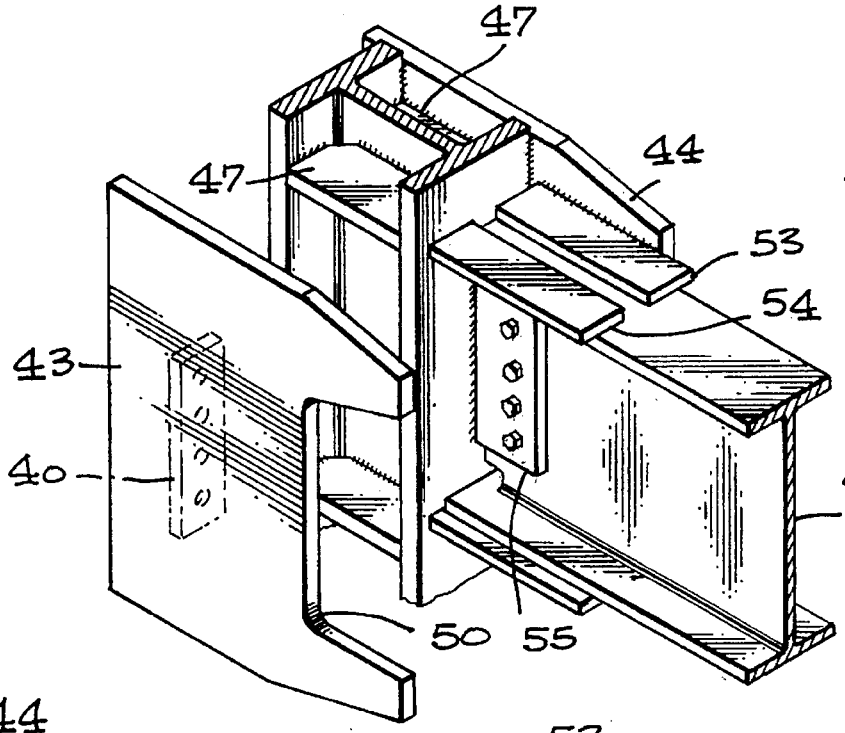
FIG. 10
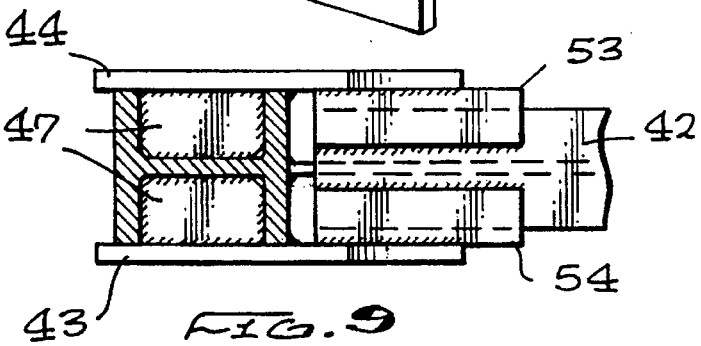
FIG. 9
FIG. 11
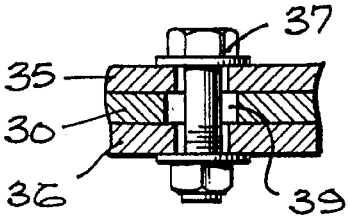

STEEL MOMENT RESISTING FRAME BEAM-TO-COLUMN CONNECTIONS

BACKGROUND OF THE INVENTION

1. Field of the Invention

The present invention relates to the field of building construction, and more particularly to a novel steel moment resisting frame (SMRF) connection. Such SMRF connections are used in the construction of both single and multistory structures of either original or retrofit construction.

2. Brief Description of the Prior Art

The prior art contains many teachings for the construction of moment connections and other related structural steel joints. These teachings have either focused on connections that allegedly reduce construction costs and facilitate erection methods, or on improving the seismic energy absorption capability of isolated load transfer mechanisms in a given joint while ignoring other critical load transfer mechanisms that are required to complete the SMRF system. Quite importantly, given the severe lessons learned in recent major earthquake activity, prior art SMRF connections are not suitable for use in seismically active areas. Examples reside in U.S. Pat. Nos. 3,952,472, 4,094,111 and 4,993,095. U.S. Pat. No. 3,952,472 to Boehmig teaches a relocatable joint connecting a horizontal beam and a vertical column. Boehmig teaches a moment connection (weld connection) between the end of his horizontal beam and the end of his parallel plates. His parallel plates are attached to the column. Boehmig's beam does not extend between the parallel plates, i.e., Boehmig's parallel plates do not overlap, or extend along the sides of, the horizontal beam as they do in the invention herein.

Prior to recently reported earthquake damage, the traditional beam-to-column SMRF connection used in most steel frame buildings was comprised of a full-penetration single-bevel groove weld connecting both beam flanges of a horizontal beam to the vertical column flange to resist earthquake lateral forces in rigid joint/moment frame action. The gravity forces were resisted by a shear-resisting tab plate that was shop welded to the column flange and field bolted in single shear to the beam web using high strength bolts.

The design approach adopted by the structural engineering community for SMRF systems in seismic areas assumes that a significant level of system ductility can be developed. This ductility is available in steel ductile frames if premature brittle failures are prevented. Testing to date of SMRF connections, following recent severe earthquake activity, suggests that the behavior of beam-to-column joints will depend on the strain rates imposed on the more brittle load transfer mechanisms along the load path.

Observed recent earthquake damage to SMRF connections consists primarily of either a partial or complete failure of the full penetration single-bevel groove weld between the beam flange and the column flange, either in the weld itself or along the heat affected zone of the column flange, pulling with it a divot of parent column steel from the face of column flange. The origination of the crack is normally at the narrow root of the groove weld profile, which is inherently subject to slag inclusions during the field welding process. These inclusions act as stress risers that initiate cracking during the impactive load from an earthquake. Stress risers are also created by the backer bar used to bridge the root gap before making the weld. The backer bar is commonly tack welded in place below each beam flange and not removed. In addition, these beam flange-to-column flange failures have resulted in shear failure of the high strength bolts connecting the beam web to the shear tab plate attached to the column flange for the support of gravity loads.

in other instances, the crack again originates at the root of the groove weld, but enters the column flange and propagates through the full thickness and width of the flange and into the column web. This particular cracking pattern appears to be more pronounced in the jumbo column sections, both rolled and built-up sections.

The effect of these recent SMRF connection failures in damaged buildings is three-fold; 1) the integrity of the seismic lateral load resistance of the connections has been seriously compromised, potentially leading to the loss of gravity support and partial collapse of the building during extended strong ground motion or aftershocks; 2) building owners and commercial property insurance carriers have lost confidence in the earthquake performance of steel buildings, and 3) the International Conference of Building Officials has issued an emergency code change that deletes the prequalified SMRF connection because of poor performance of steel moment frame beam-to-column connections in recent earthquakes and subsequent testing at the University of Texas, at Austin.

In response to this building industry crisis, practicing structural engineers, together with university researchers, metallurgical and welding engineers, steel and welding electrode manufacturers, and steel fabricators and erectors individually and collectively appear to be largely focused on ways to modify the traditional SMRF connection configuration. These modifications to the traditional SMRF connection unfortunately still rely fundamentally on the post-yield straining of large highly-restrained full-penetration single-bevel groove welds (performed under hard-to-control field conditions which can dramatically affect weld toughness) or structural steel column shapes in a through-thickness direction (i.e., 90° to the longitudinal direction of the weld or normal to the rolled grain of the steel shape), under the influence of impactive earthquake forces. As clearly demonstrated by the recently observed and reported widespread damage and subsequent testing, these joint configuration attributes do not provide a reliable mechanism for the dissipation of earthquake energy, and can lead to brittle fracture of the weld and the column. Brittle fracture is in violation of the SMRF design philosophy as codified in the Uniform Building Code. Hence the need for a novel SMRF beam-to-column connection that altogether eliminates these negative attributes, which is the subject of this invention.

SUMMARY OF THE INVENTION

Accordingly, the above problems and difficulties are obviated by the present invention which involves the novel SMRF connection configuration that joins vertical columns and horizontal beams. This invention permits using all shop fillet welds and all field bolted splices for new building construction. The novel SMRF connection is an assembly which is comprised of a primary trunk assembly welded to a column, which assembly is also welded to a secondary branch assembly. The primary trunk assembly does not include the vertical column, nor a section of the vertical column, but it is comprised of two vertical, parallel, gusset plates which are disposed on opposing sides of the column and welded to such column. The gusset plates are in face-to-face relationship, with each other. Thus, such vertical, parallel, gusset plates are spaced apart equal to the width of the column. Being spaced apart, such vertical, parallel, gusset plates are thus disposed to receive a horizontal beam between them and to be connected to such horizontal beam, thus providing a connection between the horizontal beam and the vertical column or section of vertical column. The primary trunk assembly also preferably comprises two horizontal stiffener plates welded on each side of the column to the column web and to the column flanges and, also, to the vertical, parallel, gusset plates. Both the column stiffener plates and parallel gusset plates may be welded to the column in the shop as distinguished from in the field, that is, in place, in a standing structure. In new construction, a column may be constructed by splicing column sections together in the field. Each column section, when spliced, is already attached to a primary trunk assembly and a secondary branch assembly. A column section may be spliced into forming a column by being either field bolted or field welded into the column and may include a column web tab plate to facilitate such splicing. The secondary branch assembly is secured normal to the primary trunk assembly between the parallel gusset plates. The secondary branch assembly is comprised of a rolled, flanged beam or a built-up beam that has a pair of vertical shear transfer plates (for transferring SMRF beam shear to the parallel gusset plates) welded to the web of the stub beam section and to the parallel gusset plates of the primary trunk assembly. One or more flange cover plates are secured to each flange of the beam and to the parallel gusset plates to horizontally bridge the gap between parallel gusset plates and any gap which may exist between the flanges of the horizontal beam and the parallel gusset plates. The preferred embodiment includes both horizontal flange cover plates and vertical shear transfer plates between the beam and the vertical, parallel, gusset plates. A vertical shear tab plate (to provide temporary shoring and final gravity support for the link beam that connects the juxtaposed column trees to one another in order to complete one embodiment of the inventive SMRF system) is secured to the web of the stub beam and is prepared with bolt holes near its free edge. Thus, all plates to the stub beam section (i.e., shear transfer plates, flange cover plates (as applicable) and web shear tab plate) may be welded in the shop to a stub beam section and to the parallel gusset plates. A net vertical gap is left between the end of the stub beam section closest to the face of column flange. The free end of each flange of the stub beam section is prepared with oversized bolt holes. A complete SMRF system at a given floor level, is completed by joining the beam of each secondary branch assembly with a link beam. Link beams may be bolted to the extremities of secondary branch assemblies using flange splice plates and the shear tab plate welded to the web of the stub beam section. The ends of the link beam are prepared with oversized bolt holes in each flange and with bolt holes in the web.

For retrofit construction, the existing SMRF connection is radically altered by removing the full penetration welds connecting horizontal beam flanges to vertical column flange by back-gouging and coping, and providing vertical, parallel, gusset plates with a cut-out to allow weld access for attaching the parallel gusset plates to the existing column. If no continuity plates are provided in the existing column to stiffen the column, the column flanges are locally stiffened by welding column stiffener plates to the column prior to securing the parallel gusset plates. In addition, a pair of flange cover plates are secured to the top and bottom beam flange to bridge the gap between the two vertical, parallel, gusset plates and the beam flanges. All plates (i.e., column stiffener plates, vertical, parallel, gusset plates and beam flange cover plates) are welded in the field to the existing column and beam.

It is to be particularly noted that all flange splice connections can be field bolted using high strength slip-critical bolts in double shear. All web tab plate connections are field bolted in either single or double shear using high strength bolts. Splice bolt connections are located at points of reduced flexural demand. Bolted splice plates utilize oversize holes to facilitate erection fit-up and accomplish fabrication/erection tolerances and to provide an energy dissipation mechanism through bolt slippage at high stress levels.

Therefore, it is among the primary objects of the present invention to provide a novel SMRF beam-to-column connection configuration and fabrication which eliminates altogether the post-yield straining of large highly-restrained full-penetration single-bevel groove welds and/or structural steel column shapes in the through-thickness direction and replaces these negative attributes with welds that are not restrained due to in-process shrinkage of weld metal and bolted splice configurations which are recognized to be inherently ductile fabrication and erection practices that perform particularly well under the influence of impactive earth-quake forces and which are not subject to variable field conditions.

Another object of the present invention is to provide a novel SMRF beam-to-column connection that is readily adaptable for new construction as well as retrofit construction.

Another object of the present invention is to provide a novel joint configuration for use in beam-to-column moment connections in steel moment resisting single or multi-story frame buildings that fully complies with the emergency code provisions recently issued by the International Conference of Building Officials.

Another object of the present invention is to provide a novel SMRF beam-to-column connection that may be totally fabricated off-site at a shop location for new construction and transported to a building site for bolted securement to complete the SMRF system.

Another object of the present invention is to provide a novel SMRF beam-to-column connection that is partially fabricated off-site at a shop location for retrofit construction and transported to the building site for welded securement to complete the SMRF system.

Yet a further object resides in providing for new construction a combination of welded and bolted securement between a vertical SMRF column and the end of a SMRF horizontal beam which is capable of transferring and dissipating seismic lateral impactive forces while providing positive gravity support during and after a major earthquake.

Another object resides in employing oversize bolt holes in securement of the link beam assembly in new construction to facilitate erection fit-up, accommodate fabrication and erection tolerances and to provide an energy dissipation mechanism through bolt slippage at high stress levels.

BRIEF DESCRIPTION OF THE DRAWINGS

The features of the present invention which are believed to be novel are set forth with particularity in the appended claims. The present invention, both as to its organization and manner of operation, together with further objects and advantages thereof, may best be understood with reference to the following description, taken in connection with the accompanying drawings in which:

FIG. 7 is a view similar to the view of FIG. 3 showing the SMRF connection configuration adapted to use in retrofit construction;

FIG. 8 is an end view of the SMRF connection configuration shown in FIG. 7;

FIG. 9 is a plan view of the SMRF connection configuration shown in FIGS. 7 and 8;

FIG. 10 is a partially exploded isometric view of the SMRF connection configuration shown in FIG. 7; and FIG. 11 is an enlarged cross-sectional view of the bolted flange between the extremity of the secondary branch assembly stub beam section and the link beam assembly, illustrating the oversize hole through which a high strength slip-critical bolt is disposed.

DESCRIPTION OF THE PREFERRED EMBODIMENT

Figure 1:
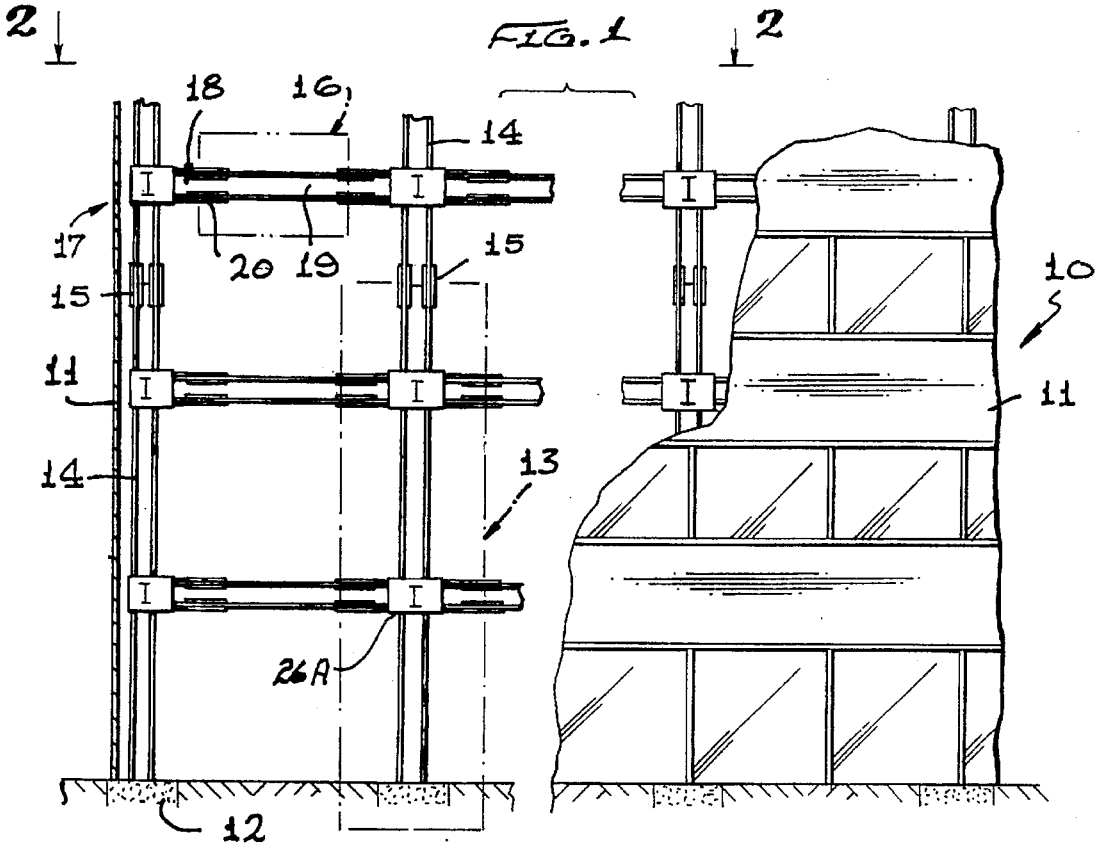
FIG. 1 is a diagrammatic view, partly in section, of a multi-story SMRF building employing the novel SMRF beam-to-column connections embodying the present invention.

Referring to FIG. 1, a steel moment resisting frame (SMRF) building is indicated in the general direction of arrow 10 which includes an interior curtain wall system 11 which includes suitable windows adjacent to different floors and suitable doors for ingress and egress to and from the building. Inside the exterior curtain wall system, the complete SMRF system is provided for resisting earthquake lateral forces and for gravity forces acting on the building, on a foundation 12. The novel SMRF system is comprised of a plurality of juxtaposed column tree assemblies 13 connected laterally by link beam assemblies 16 at each floor level, and connected vertically (as applicable) by column splices 15. The column tree assembly 13 includes a vertical column 14 which may include a splice 15 so that a plurality of column tree assemblies may be connected together as the building frame is erected. The novel column tree assembly 13 incorporating the present invention is comprised of a primary trunk assembly 17 which couples to a secondary branch assembly 18. It is noted that the link beam assembly 16 is oriented in a horizontal manner so that each end of the link beam 19 resides adjacent to the free end of the secondary branch assembly for splicing purposes, to complete the SMRF system.

Although a completed construction is shown, it is to be understood that the primary trunk assembly attached to a column section and the secondary branch assembly, including the link beam, may be shop fabricated as separate components, with the primary trunk assembly and the secondary branch assembly joined in the shop into a column tree assembly, prior to transport to the erection site. In this manner, all welding procedures can be done under controlled conditions within the shop, while splice connection 20 of the link beam to the juxtaposed column tree assemblies can be done by field bolting at the job site. Shop welding of the SMRF connection can be done for assembling the primary trunk assembly 17 at the shop while the energy dissipation mechanism 20 using bolted connections with oversized bolt holes can be constructed at the job site.

Figure 2:
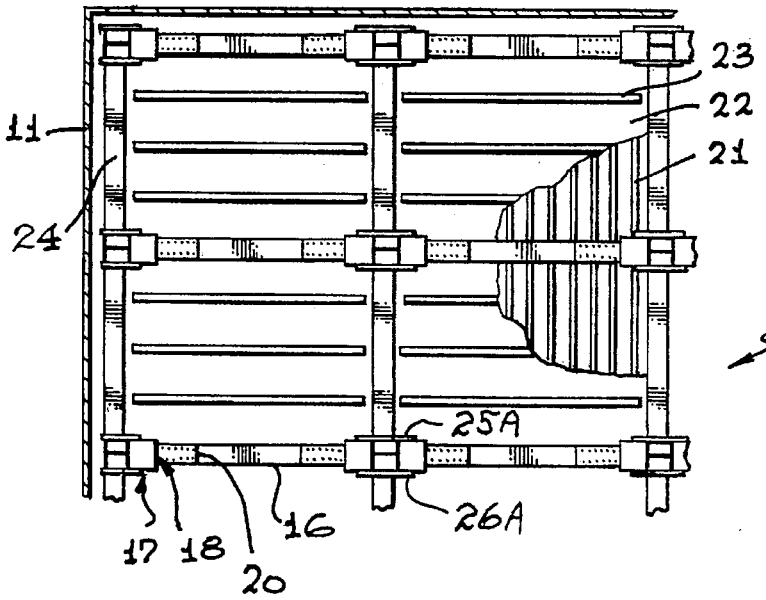
FIG. 2 is a plan view of the structure shown in FIG. 1 as taken in the direction of arrows 2—2 thereof.
Figure 4:
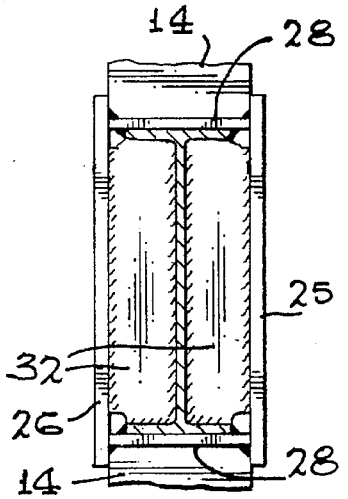
FIG. 4 is a section through the stub beam as taken in the direction of arrows 4—4 of FIG. 3.
Figure 3:
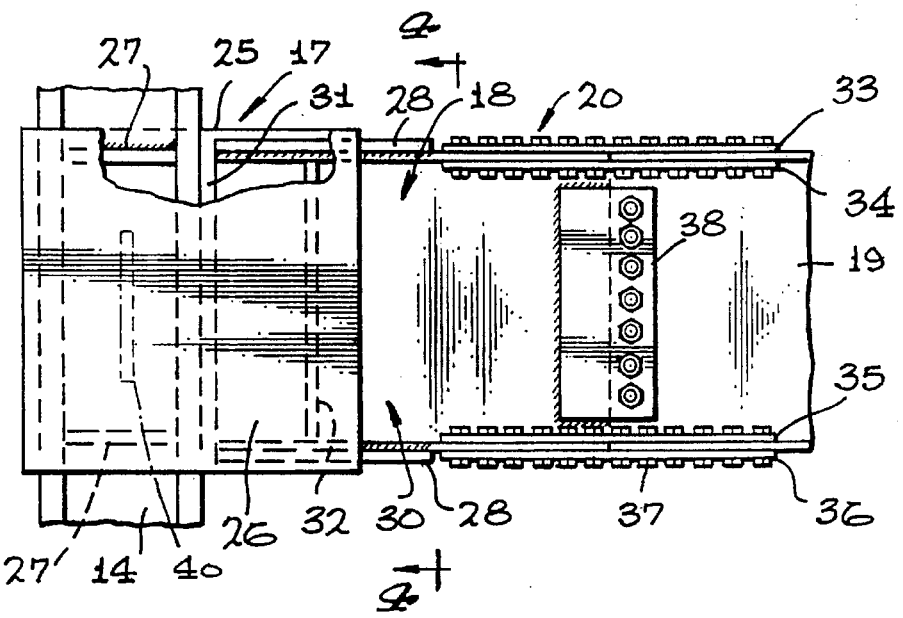
FIG. 3 is an enlarged elevational view of the SMRF connection configuration between a vertical column and a horizontal beam employing the inventive concepts.
Figure 5:
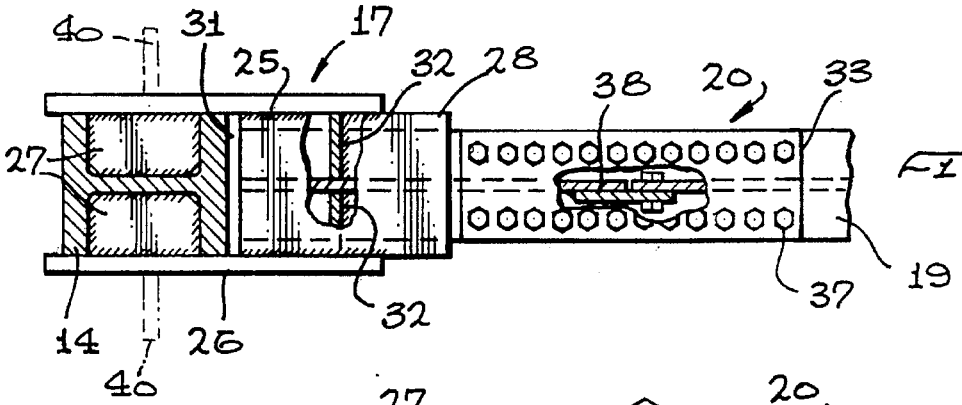
FIG. 5 is an enlarged plan view of the SMRF connection configuration shown in FIG. 3 with portions broken away to show underlying joints.

Referring to FIG. 2, a typical metal decking with concrete fill or other suitable floor system is indicated by numeral 21 and a floor covering is indicated by numeral 22. The flooring is supported by typical floor beams 23.

The primary trunk assembly and the secondary branch assembly, as well as the link beam assembly, will now be described. In general, the column tree assembly is preferably comprised of all fillet-welded component construction which joins together a primary trunk assembly with a secondary branch assembly. The attachment of the free end of the secondary branch assembly to the link beam assembly is a field bolted procedure which includes the energy dissipation mechanism.

Figure 6:
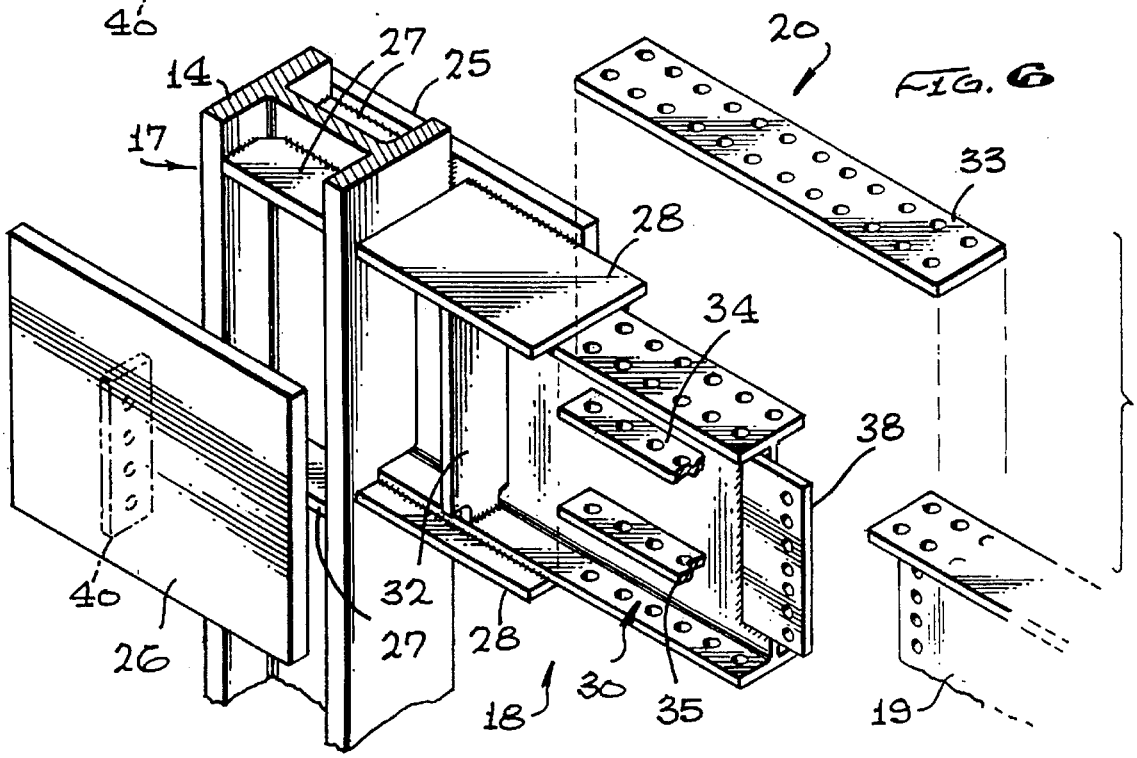
FIG. 6 is an exploded isometric view of the SMRF connection configuration shown in FIGS. 3, 4 and 5 illustrating the relative relationship of all components.

The inventive SMRF beam-to-column connection configuration for new building construction is illustrated in FIGS. 3–6 inclusive. The link beam and stub beam section may take the form of a rolled wide flange steel shape or it may be a built-up section constructed of steel plate. The primary trunk assembly 17 is welded to a column section 14 that is stiffened with two pairs of stiffener plates 27 at each beam-to-column location (i.e. near the vertical location of each beam flange). The two vertical, parallel gusset plates 25 and 26 are welded to the column along the exterior corner edge of each column flange. As may be seen in FIGS. 5 and 6, such vertical, parallel, gusset plates are in face-to-face relationship with each other. The parallel gusset plates and column stiffener plates are fillet welded to the column section 14. A secondary branch assembly 18 is secured normal to the primary trunk assembly 17 within the gap provided by the parallel gusset plates 25 and 26. The secondary branch assembly 18 is comprised of a stub beam section 30 that is welded to a pair of vertical shear transfer plates 32 which, in turn, are welded to the parallel gusset plates 25 and 26. It can be seen from FIG. 3 that plate 32 is disposed toward the end of plate 26. A gap 31 is provided between the terminating end of the stub beam section 30 and the opposing flange surface of vertical column 14. When the stub beam section 30 is a rolled structural stub, a flange cover plate 28 which is, in other words, horizontal plate means is provided and welded to each flange of the stub beam and to the parallel gusset plates 25 and 26 to horizontally bridge the gap between vertical, parallel, gusset plates. When the stub beam section is a built-up section using steel plate, the flange width of the built-up section is cut to bridge the gap, eliminating the need for flange cover plates. Thus, in this embodiment, as distinguished from the embodiment shown in FIG. 6, the beam flanges bridge the entire gap between the vertical, parallel, gusset plates and, thus, are wide enough for the flanges themselves to be welded to the vertical, parallel, gusset plates, without the necessity of flange cover plates to bridge the gap. Thus, there are various embodiments of using weld securement means to attach the beam to the vertical, parallel, gusset plates. In this instance, in which the flange of the beam is wide enough, the weld securement means is simply the welds between the flanges of the beam and the vertical, parallel, gusset plates. In the cases of FIGS. 6 and 8, the weld securement means comprise horizontal plate means, that is, flange cover plates 28, FIG. 6, or 53 and 54, FIG. 8, as the case may be, which are welded to the flanges of the beam and, also, to the vertical, parallel, gusset plates. The secondary branch assembly is also fitted with a vertical shear tab plate 38 that is secured to the web of the stub beam 30 and is prepared with bolt holes near its free edge to permit making a spliced field-bolted web connection to the link beam assembly 16. All plates secured to the stub beam section (i.e. 32, 28 and 38) may be shop-welded to the stub beam section 30 and to the parallel gusset plates 25 and 26. The free end of each flange of the stub beam section is prepared with oversized bolt holes 39 to receive the spliced field bolted flange connection plates 33 connecting the link beam assembly 16. The flanges at the ends of link beam assembly 16 are also prepared with oversized holes to receive splice connection plates 33.

Attachment of the splice plates to the flanges of the respective beams is achieved by a plurality of bolts, such as bolt 37. All bolted splice connections of the completed SMRF system, including the primary trunk assembly, secondary branch assembly, and link beam assembly may be field bolted using high-strength slip-critical bolts in double shear. All web tab plate connections may be field bolted in either single or double shear, as necessary, using high-strength bolts. Splice connections are located at frame points of reduced flexural demand. The bolted flange splices utilize over-size holes in the parent beam sections, such as shown in FIG. 11, wherein bolt 37, as an example, is shown having a shank which passes through over-size hole 39 in the flange of beam 30, as an example, between flange splice plates 35 and 36 which is an example of a bolt in double shear. The over-size holes, whether they be in the web or flanges of the respective beams, facilitate erection fit-up and accommodate fabrication and erection tolerances and provide an energy dissipation mechanism through bolt slippage at high stress levels. Therefore, in summary with respect to the novel SMRF beam-to-column connection shown in FIGS. 3–6 inclusive, it can be seen that the primary trunk assembly 17, together with the column section 14 to which it is attached, and the secondary branch assembly 18, which includes the stub beam section 30, can all be fabricated in the shop for use in either new construction or retrofit construction.

Referring to FIGS. 7–10 inclusive, the SMRF beam-to-column connection is disclosed to achieve retrofit or rehabilitation of existing traditional seismic moment resisting frame joint connections in steel buildings. The retrofit SMRF connection is illustrated in the general direction of arrow 41 and is employed to connect one end of an existing SMRF horizontal beam 42 to SMRF vertical column 46. The retrofit SMRF connection 41 includes a pair of parallel gusset plates 43 and 44 which are disposed on opposite sides of the existing column 46 and are joined therewith by welds and by a pair of upper and lower column stiffener plates 47. These plates, as well as the vertical, parallel, gusset plates, are similar to those previously described for original (new) construction. It is noted that in this adaptation of the novel SMRF beam-to-column connection, a tailored smooth cut-out, indicated by numerals 50 and 51, are required in each companion gusset plate to allow field access in order to weld the gusset plates along the edges of the column flanges. Prior to welding the gusset plates to the column flange, the existing restrained full-penetration, single-bevel groove welds at each beam flange are removed by back-gouging and coping out the flange material at the location of existing weld web-access holes, as indicated by numeral 52, and grinding back the balance of flange weld material to the face of the column to a smooth competent surface. In addition, two new beam flange cover plates, as indicated by numerals 53 and 54, are welded to both the top and bottom beam flanges and the vertical, gusset plates 43 and 44 to bridge the gap between the two vertical, parallel, gusset plates and the beam flanges. Continuity plates are common in existing columns. Such continuity plates are for the purpose of providing structural continuance of a beam through a column. Such continuity plates are similar in location and structure to stiffener plates 47, but have a different primary purpose. If no continuity plates are provided in the existing column panel zone, the column is locally stiffened with two pairs of stiffener plates 46 and 47 near the vertical location of each beam flange, prior to attaching the companion vertical, parallel, gusset plates. The existing beam shear tab plate connection, as indicated by numeral 55, is left unaltered or, as may be deemed necessary, appropriate strengthening by fillet welding around perimeter of the free edges of the tab plate may be performed.

In summary, the structural engineering community, together with steel frame building owners and material/welding experts, remain stunned by the significant and widespread damage suffered during recent earthquake activity by the heretofore traditional conventional steel moment resisting frame (SMRF) beam-to-column joint connections employed in steel buildings.

The reported SMRF connection failures attributed to earthquake occurrence are particularly treacherous because of their subtlety in being detected. In many instances, the structural damage is accompanied by only relatively minor stress to architectural finishes and virtually no global structural out-of-plumbness is experienced. Because the structural damage is generally not readily detectable on the basis of distress to architectural finishes, there is reason to believe that similar damage to steel frame buildings with traditional SMRF connections may already exist and remain undetected in other seismically active areas.

In view of the foregoing, it can be seen that the inventive SMRF beam-to-column connection configuration and fabrication provides a complete departure from the heretofore traditional SMRF beam-to-column joint configuration and fabrication approach (including modifications and/or adaptations of same) by eliminating altogether the unseemly welded connection between the beam flanges and the face of column flange that relies fundamentally on the post-yield straining of either (1) large highly-restrained full-penetration single-level groove welds performed under hard-to-control field conditions which can dramatically affect weld toughness and/or (2) structural steel column shapes in a through-thickness direction (i.e. 90° to the longitudinal direction of the weld or normal to the rolled grain of the steel shape), to resist impactive earthquake forces. The novel SMRF beam-to-column connection configuration and fabrication approach disclosed in this invention replaces it with simple unrestrained inherently-ductile fabrication and erection practices that have performed well during past earthquakes without serious incident and are not subject to variable field conditions. The inventive. SMRF beam-to-column connections for new construction may comprise all shop fillet-welded construction and all field bolted splice connections. The adaptation of this inventive SMRF beam-to-column connection for retrofit of existing traditional SMRF connections may comprise all field fillet-welded construction. The load transfer mechanisms involved in the novel SMRF connection configuration do not impose post-yield straining of either the fillet welds or the structural steel column shapes in the through-thickness direction. In addition, the size of the fillet welds is relatively small because of the ample dimensions provided by the parallel gusset plates in proportioning the joint configuration. In addition, the problem of cracks being initiated during an earthquake because of stress risers created by slag inclusions at the root of the single-bevel groove weld and/or by tack welded backer bars that are left in place is totally eliminated with the use of all fillet-welded construction. The integrity of fillet weld construction in the inventive SMRF beam-to-column connection is further enhanced for new construction since it is all performed in the shop where controls on quality are easier to enforce and variable field conditions are mitigated. Welds other than fillet welds are well-known and in common use, such as penetration welds, groove welds and still other welds. In particular circumstances, such other welds may be found suitable, but the fillet weld is the preferred embodiment in this inventive connection. It is usually most economical. Accordingly, the present invention is a radical departure from what has normally been done in designing and fabricating seismic moment resisting frame systems to date. All joint connections of the present invention can be designed to develop as required in excess of the plastic moment capacity ($M_p$) of the connected beam.

Additionally, adaptations include the ability to provide moment resisting capability for a given box column in each principal building direction, i.e. about both axes of the box column, using a pair of secondary parallel gusset plates disposed as described in the example. In FIG. 2, it may be seen that beams may be connected to both sides of the column by the use of extended vertical, parallel, gusset plates 25A and 26A, which are simply longer gusset plates than those illustrated in FIG. 6. That is, the gusset plates 25A and 26A extend outwardly from the column in opposing directions. Of course, the gusset plates 43 and 44 of FIG. 10 may likewise be made longer in order to connect While particular embodiments of the present invention have been shown and described, it will be obvious to those skilled in the art that adaptations and modifications may be made without departing from this invention in its broader aspects and, therefore, the aim in the appended claims is to cover all such changes and modifications as fall within the true spirit and scope of this invention. Examples of such adaptations and modifications include the ability to provide biaxial moment resisting capability for a given SMRF column in each principal axis of the column, using a pair of secondary parallel gusset plates welded to each primary parallel gusset plate to engage an orthogonal secondary branch assembly.

What is claimed is:

1. A structural joint connection comprising a horizontal beam connected to a vertical column, said beam having top and bottom flanges and a web between said flanges, said joint connection comprising two vertical plates disposed in parallel relationship on opposite sides of said column, said vertical plates being in face-to-face relationship with respect to each other, and welded to said column, said vertical plates extending horizontally from said column along the sides of said horizontal beam, plate means attached to said horizontal beam flanges by horizontal welds, said plate means further attached to said vertical plates by horizontal welds, said horizontal welds extending longitudinally in the direction of said horizontal beam.

2. The joint connection of claim 1 wherein is included two vertical shear transfer plates, disposed on opposite sides of said beam and wherein each of said vertical shear transfer plates is welded to said web of said beam and along a vertical line to a respective vertical plate.

3. The joint connection of claim 2 wherein each said vertical shear transfer plate has two ends and each said vertical shear transfer plate is further connected to said flanges by welds along each end of each said shear transfer plate.

4. The joint connection of claim 1 wherein is included one or more vertical shear transfer plates, each vertical shear transfer plate being welded by a vertical weld to said web of said beam and wherein each said vertical shear transfer plate is also welded to one of said vertical plates by a vertical weld.

5. The joint connection of claim 4 wherein each said vertical shear transfer plate has opposing ends and wherein each said vertical shear transfer plate is further connected to the flanges of said beam by fillet welds at opposing ends of each said vertical shear transfer plate.

6. The joint connection of claim 1 wherein said vertical, parallel, plates are welded to said column by vertical fillet welds.

7. The joint connection of claim 4 wherein said column has two flanges and each said vertical, parallel, plate is welded to both said flanges and wherein each said vertical shear transfer plate is welded to said top and bottom flanges of said beam.

8. The combination recited in claim 1 in which said column comprises four vertical edges, two of said edges being on the side of said column proximate to said horizontal beam and two of said edges being on the side remote from said horizontal beam and wherein said vertical plates each comprise a cut-out portion, said cut-out portion being on the same side of said column as said proximate edges.

9. The combination recited in claim 8 in which said cut-out portion is sufficiently large to allow access to weld said vertical plates to said vertical edges on the side of said column proximate to said horizontal beam.

10. A structural joint connection comprising a horizontal beam connected to a vertical column having vertical edges, said joint connection comprising two vertical plates disposed on opposite sides of said column and wherein said vertical plates are welded along vertical lines to said vertical edges of said column, wherein said vertical plates are in face-to-face relationship with respect to each other, and wherein said vertical plates extend from said column along the sides of said beam and wherein is included weld securement means attaching said vertical plates to said beam, said weld securement means comprised of welds running longitudinally in the direction of said horizontal beam on said horizontal beam and on said vertical plates.

11. The structural joint connection of claim 10 wherein said column is comprised of four vertical edges and said welded, vertical lines comprise fillet welds disposed along all said four edges of said column between said column and said vertical plates.

12. The structural joint connection of claim 10 wherein said vertical plates are further attached to said column by horizontal stiffener plates welded to said column and welded to said vertical plates.

13. The structural joint connection of claim 10 wherein said beam comprises top and bottom flanges and a web between said top and bottom flanges and wherein said weld securement means attaching said vertical plates to said horizontal beam comprises welds extending horizontally between said vertical plates and said top and bottom flanges of said horizontal beam and wherein is further included two vertical shear transfer plates each having one or more vertical edges, each of said vertical shear transfer plates welded along one of said vertical edges to a respective vertical plate and wherein each of said vertical shear transfer plates is also welded to one or more of said web and said flanges.

14. The structural joint connection of claim 10 wherein said horizontal beam comprises top and bottom flanges and a web between said top and bottom flanges and wherein said weld securement means, welding said vertical plates to said horizontal beam, comprises horizontal plate means welded along horizontal lines to said vertical plates and wherein said horizontal plate means are welded along horizontal lines to said top and bottom flanges of said horizontal beam and wherein is further included two vertical shear transfer plates each having one or more vertical edges, each of said vertical shear transfer plates welded along one of said vertical edges to a respective vertical, plate and wherein each of said vertical shear transfer plates is also welded to one or more of said web and said flanges.

15. The structural joint connection of claim 14 wherein said plate means comprises one upper plate and one lower plate, and wherein said weld securement means is comprised of welds between said upper plate and said top flange and welds between said upper plate and said vertical plates and wherein said weld securement means is comprised of welds between said lower plate and said bottom flange and welds between said lower plate and said vertical plates and wherein said welds between said horizontal plates and said flanges run longitudinally in the direction of said horizontal beam.

16. A moment resisting frame connection comprising a horizontal beam connected to a vertical column, the combination which comprises:

a secondary branch assembly comprising said horizontal beam, said beam having top and bottom flanges and intermediate web;

a primary trunk assembly comprising a pair of vertical, parallel, gusset plates welded to opposite sides of said column, said gusset plates being in face-to face relationship with respect to each other, said primary trunk assembly further comprising column stiffener plates welded to said column and to said gusset plates;

and wherein said vertical, parallel, gusset plates extend horizontally beyond said column with a gap between said gusset plates;

and wherein said beam extends into said gap between said vertical, parallel, gusset plates;

and wherein said secondary branch assembly further comprises horizontal plate means welded between said beam and said vertical, parallel, gusset plates;

and wherein said secondary branch assembly further comprises vertical, shear transfer plates welded to said web of said beam, said vertical, shear transfer plates being further welded to said vertical, parallel, gusset plates, said vertical shear transfer plates being disposed within said gap between said gusset plates.

17. The moment connection of claim 16 wherein said beam and said vertical, parallel, gusset plates are welded to said horizontal plate means by welds extending in the longitudinal direction of said beam.

18. The moment connection of claim 17 wherein said vertical shear transfer plates are welded to said flanges of said beam.

* * * * *